US009617611B2

(12) United States Patent
Grobler et al.

(10) Patent No.: US 9,617,611 B2
(45) Date of Patent: Apr. 11, 2017

(54) QUENCHING PROCESS AND APPARATUS FOR PRACTICING SAID PROCESS

(75) Inventors: Werner Hendrik Grobler, Holmes Beach, FL (US); Bernd Edenhofer, Kleve (DE); Craig A. Moller, Roscoe, IL (US)

(73) Assignee: IPSEN, INC., Cherry Valley, IL (US)

( * ) Notice: Subject to any disclaimer, the term of this patent is extended or adjusted under 35 U.S.C. 154(b) by 823 days.

(21) Appl. No.: 13/427,008

(22) Filed: Mar. 22, 2012

(65) Prior Publication Data

US 2012/0247627 A1 Oct. 4, 2012

Related U.S. Application Data

(60) Provisional application No. 61/468,267, filed on Mar. 28, 2011.

(51) Int. Cl.

| | |
|---|---|
| ***C21D 1/667*** | (2006.01) |
| ***C21D 1/56*** | (2006.01) |
| ***C21D 1/613*** | (2006.01) |
| ***C21D 1/767*** | (2006.01) |
| ***C21D 1/773*** | (2006.01) |
| *C21D 9/00* | (2006.01) |
| *C21D 11/00* | (2006.01) |

(52) U.S. Cl.

CPC ..... *C21D 1/613* (2013.01); *C21D 1/767* (2013.01); *C21D 1/773* (2013.01); *C21D 9/0062* (2013.01); *C21D 11/005* (2013.01)

(58) Field of Classification Search

CPC ..... C21D 1/613; C21D 1/767; C21D 11/005; C21D 9/0062; C21D 1/773

USPC ..... 266/114; 148/713, 712, 559, 714, 627, 148/637, 652, 654, 639, 660, 662, 644

See application file for complete search history.

(56) References Cited

U.S. PATENT DOCUMENTS 4,532,984 A * 8/1985 Smith, Jr. ..... 165/61
5,702,540 A * 12/1997 Kubota ..... 148/223

(Continued)

FOREIGN PATENT DOCUMENTS

DE 102005015450 8/2006
DE 102009053066 5/2011

(Continued)

OTHER PUBLICATIONS

European Search Report, EP 2505676 A1, pp. 16-17, Aug. 29, 2012.

(Continued)

*Primary Examiner* — Scott Kastler
*Assistant Examiner* — Michael Aboagye
(74) *Attorney, Agent, or Firm* — Dann, Dorfman, Herrell and Skillman, P.C.

(57) ABSTRACT

A process for quenching heat treated metal parts using a liquid quenchant and high pressure is disclosed. In general, the process includes the steps of providing a load of heat treated metal parts in a pressure vessel wherein the load is at an elevated temperature after being heat treated. In a subsequent step, a liquid quenchant is injected into the pressure vessel such that a vapor of the liquid quenchant forms rapidly in the pressure vessel and cools the metal parts. The step of injecting the liquid quenchant into the pressure vessel is continued for a time sufficient to establish a desired peak vapor pressure in the pressure vessel. An apparatus for carrying out the disclosed process is also described.

39 Claims, 4 Drawing Sheets

(56) References Cited

U.S. PATENT DOCUMENTS

| | | | | |
|---|---|---|---|---|
| 6,746,225 | B1 * | 6/2004 | McHugh | B22F 3/115 164/20 |
| 2005/0104266 | A1 * | 5/2005 | Kobasko et al. | 266/252 |
| 2005/0193743 | A1 * | 9/2005 | Foss | C21D 1/62 62/50.2 |
| 2011/0262877 | A1 | 10/2011 | Katsumata | |
| 2011/0275024 | A1 | 11/2011 | Katsumata | |
| 2012/0028202 | A1 | 2/2012 | Katsumata | |

FOREIGN PATENT DOCUMENTS

| | | | | |
|---|---|---|---|---|
| EP | 1367139 | * | 12/2003 | C21D 1/613 |
| GB | 1452062 | * | 10/1976 | C21D 1/62 |
| JP | 5651519 | | 5/1981 | |
| JP | 6059014 | | 4/1985 | |
| JP | 60262913 | | 12/1985 | |
| JP | 10183236 | | 7/1998 | |
| JP | 11153386 | | 6/1999 | |
| JP | 2005113166 | | 4/2005 | |
| WO | 2011071153 | | 6/2011 | |
| WO | 2011118737 | | 9/2011 | |
| WO | 2011129340 | | 10/2011 | |

OTHER PUBLICATIONS

Japanese Patent Appln. No. 2012-73687, Office Action, Mar. 25, 2014; pp. 1-7.

W. Buecker. The Cryogenic Rapid Cooling Process, 8th ASM Heat Treating Conference, Detroit, Sep. 18, 1984, 12 pages.

B. Liscic, Controllable heat extraction technology—what it is and what it does, Int. J. Material and Product Technology, Viol. 24, Nos. 1-5, pp. 170-183, 2005.

* cited by examiner

QUENCHING PROCESS AND APPARATUS FOR PRACTICING SAID PROCESS

CROSS REFERENCE TO RELATED APPLICATION

This application claims the benefit of U.S. Provisional Application No. 61/468,267, filed Mar. 28, 2011, the entire disclosure of which is incorporated herein by reference.

BACKGROUND OF THE INVENTION

Field of the Invention

This invention relates to a method for quenching heat treated metallic work pieces and to an apparatus for carrying out the method.

Description of the Related Art

In some of the known heat treatment systems, a high pressure gas quench subsystem is used to rapidly cool the metal work pieces from the heat treatment temperature. As shown in FIG. 1, the quenching subsystem includes an accumulator tank 1 that stores a large volume of the quenching gas at a high pressure. When the accumulator tank empties into the furnace or a standalone quenching chamber 2, the gas pressure in the furnace or the quench chamber, as the case may be, rises quickly to the desired quenching level.

In the case where the final quench pressure is high, e.g., on the order of about 20-30 bar, for example, many large accumulator tanks would be required, each storing gas at a pressure much higher than the final quenching pressure. Such tanks are expensive and take up a lot of space in the processing facility. The rapid filling of the furnace requires a large pipe and valve size to allow the furnace to reach the final quench pressure in a short time. In order to pressurize the large accumulator tanks to the required high pressures, a compressor system or very high pressure gas delivery system is sometimes employed. Both of those systems require additional energy to fill the tanks. That energy ultimately is wasted because it does not convert into useful energy in the furnace quenching process.

The main problems the invention is meant to address are summarized as follows.

1) Physical space used by high pressure backfill tank(s).
2) The compressor systems that charge these tanks to high pressures (up to 30 bar or more) have periodic maintenance issues with wear parts and also add unwanted energy into the process of furnace quenching.
3) If a compressor system is not used, the end user of the furnace equipment would have to change the bulk gas storage system in the facility and the high pressure gas delivery line from what would be typically a 10 bar or an 18 bar gas delivery system to at least a 30 bar gas delivery system.
4) Typically gas is kept in a liquid state in bulk storage systems. It takes energy to change the gas into a liquid form, energy that the end user already paid for when they bought the liquid gas. If the liquid gas is used downstream of the bulk storage system, it commonly goes through a vaporizer to turn it back into a gaseous state before delivery. The conversion of liquid gas to the gaseous state gives up stored energy by cooling the vaporizer. This energy is wasted and is not useful in the furnace quenching process.

SUMMARY OF THE INVENTION

This invention provides a process and associated apparatus to deliver a liquid, a liquefied quenching gas or vapor directly into a furnace chamber such that the liquid, liquefied gas, or vapor converts to a fully gaseous state thereby rapidly increasing the pressure inside the chamber.

The process and apparatus according to this invention eliminate the need for large high pressure gas storage tanks. The conversion of liquefied gas to the gaseous state inside the furnace chamber utilizes the energy stored in the liquefied gas and eliminates the need for compressors or other high pressure gas delivery systems.

In accordance with a first aspect of the present invention there is provided a method for rapidly cooling a load of heat treated metal parts from an elevated temperature. The method includes the steps of injecting a pressurized liquid quenchant into a pressure vessel containing a load of heat treated metal parts such that a vapor of the liquid quenchant forms rapidly and cools the metal parts and continuing to inject the pressurized liquid quenchant for a time sufficient to establish a desired peak vapor pressure in the pressure vessel. Preferably the liquid quenchant is readily vaporizable at temperatures and pressures utilized for the heat treatment of metal work pieces.

In a preferred embodiment of the process the pressurized liquid quenchant is injected for a time sufficient to establish a vapor pressure in the pressure vessel of about 5 to 100 bar.

In another preferred embodiment the quenchant vapor is circulated in the pressure vessel at high velocity while the liquid quenchant is injected into the pressure vessel such that the quenchant vapor penetrates through the load of metal parts.

In another preferred embodiment the injecting step includes the step of spraying the liquid quenchant in a preselected direction in the pressure vessel.

In further preferred process, the injecting step includes providing the liquid quenchant at an initial pressure prior to the start of the injecting step that is higher than the desired peak vapor pressure in the pressure vessel. Preferably the initial pressure of the liquid quenchant is higher than the quenchant vapor pressure in the pressure vessel by at least about 3 bar.

Preferably, the method comprises the step of continuously raising the pressure of the liquid quenchant during the injecting step such that the liquid quenchant pressure is always higher than the instantaneous quenchant vapor pressure in the pressure vessel.

Preferably the process includes the step of continuously raising the pressure of the liquid quenchant during the injecting step such that the liquid quenchant pressure is about 3 to 5 bar higher than the instantaneous vapor pressure in the pressure vessel.

Preferably the injecting step is stopped once the desired peak vapor pressure in the pressure vessel is reached.

In another preferred embodiment the steps of maintaining the peak quenchant vapor pressure in the pressure vessel and continuing to circulate the quenchant vapor are carried out for a time sufficient to lower the temperature of the metal parts to a temperature lower than the elevated temperature of the metal parts.

Preferably the process includes the step of continuing the injecting step for a period of time after the peak vapor pressure in the pressure vessel is reached.

Preferably the peak vapor pressure in the pressure vessel is maintained at the desired level by exhausting a portion of the quenchant vapor from the pressure vessel.

Preferably the peak vapor pressure in the pressure vessel is maintained at the desired level by injecting additional liquid quenchant into the pressure vessel.

A further preferred embodiment includes the step of reducing the quenchant vapor pressure in the pressure vessel to a lower pressure when the load of metal parts reaches the first lower temperature.

Preferably the method includes the step of holding the quenchant vapor pressure in the pressure vessel at the lower pressure until the load of metal parts reaches a selected final temperature.

In a still further preferred embodiment the circulating step includes circulating the quenchant vapor through a heat exchanger and circulating a heat absorbing fluid in the heat exchanger to absorb heat from the quenchant vapor.

In a still further embodiment the injecting step is carried out with a flow rate that is effective to raise the vapor pressure in the pressure vessel to the desired peak vapor pressure within about 2 to about 60 seconds from the start of the injecting step.

In one embodiment, the process according to the invention uses a liquefied gas as the quenchant. In a particularly preferred embodiment the liquid quenchant is selected from the group consisting of liquefied nitrogen, liquefied helium, liquefied argon, liquefied air, a liquefied hydrocarbon gas, liquefied carbon dioxide, and a combination thereof. In another embodiment, a liquid quenchant such as water or an aqueous quenchant solution can be used to provide a high pressure steam quench. In a further embodiment, the process according to this invention is carried out with oil as the liquid quenchant.

In accordance with a second aspect of this invention, there is provided an apparatus for rapidly cooling a work load of heat treated metal parts. An apparatus according to the invention includes a pressure vessel having an internal chamber for holding a work load of heat treated metal parts. The apparatus also includes a liquid quenchant supply vessel adapted to contain a liquid quenchant at a first pressure and a quenchant conducting means for conducting the liquid quenchant from the supply vessel to the internal chamber of the pressure vessel. The apparatus further includes a pressure control means operatively connected to the pressure vessel and the quenchant conducting means for maintaining the liquid quenchant conducted to the pressure vessel at an elevated pressure differential sufficient to establish a desired peak vapor pressure in the internal chamber of the pressure vessel.

Preferably the pressure control means is adapted for controlling the flow rate of the liquid quenchant from the supply vessel to the internal chamber of the pressure vessel.

Preferably the quenchant conducting means comprises means for increasing the pressure of the liquid quenchant conducted to the pressure vessel which may be embodied as a liquid pump or a source of pressurized gas.

In another preferred embodiment the quenchant conducting means includes a storage tank adapted for concurrently holding liquid and vapor phases and means for increasing the vapor pressure inside the storage tank.

In a still further preferred embodiment the means for spraying the liquid quenchant comprises at least one spray nozzle mounted in the pressure vessel and connected to the means for conducting the liquid quenchant.

BRIEF DESCRIPTION OF THE SEVERAL VIEWS OF THE DRAWINGS

The foregoing summary of the invention as well as the following detailed description of the invention will be better understood when read in conjunction with the drawings, wherein.

DETAILED DESCRIPTION

Figure 1:
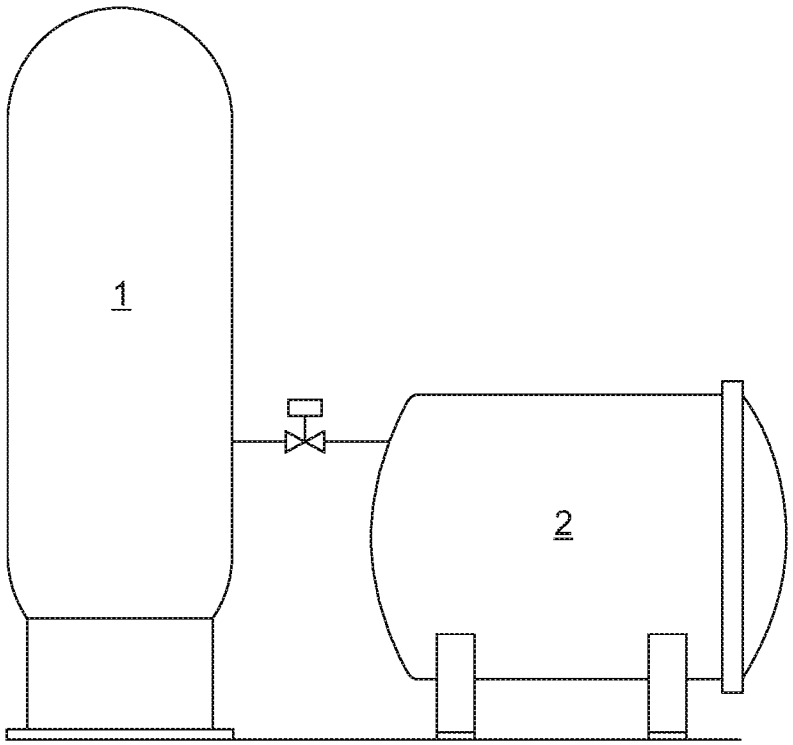
FIG. 1 (PRIOR ART)
FIG. 1 is a schematic diagram of a known system for supplying a quenching gas at high pressure to a pressure vessel chamber or quenching chamber.
Figure 2:
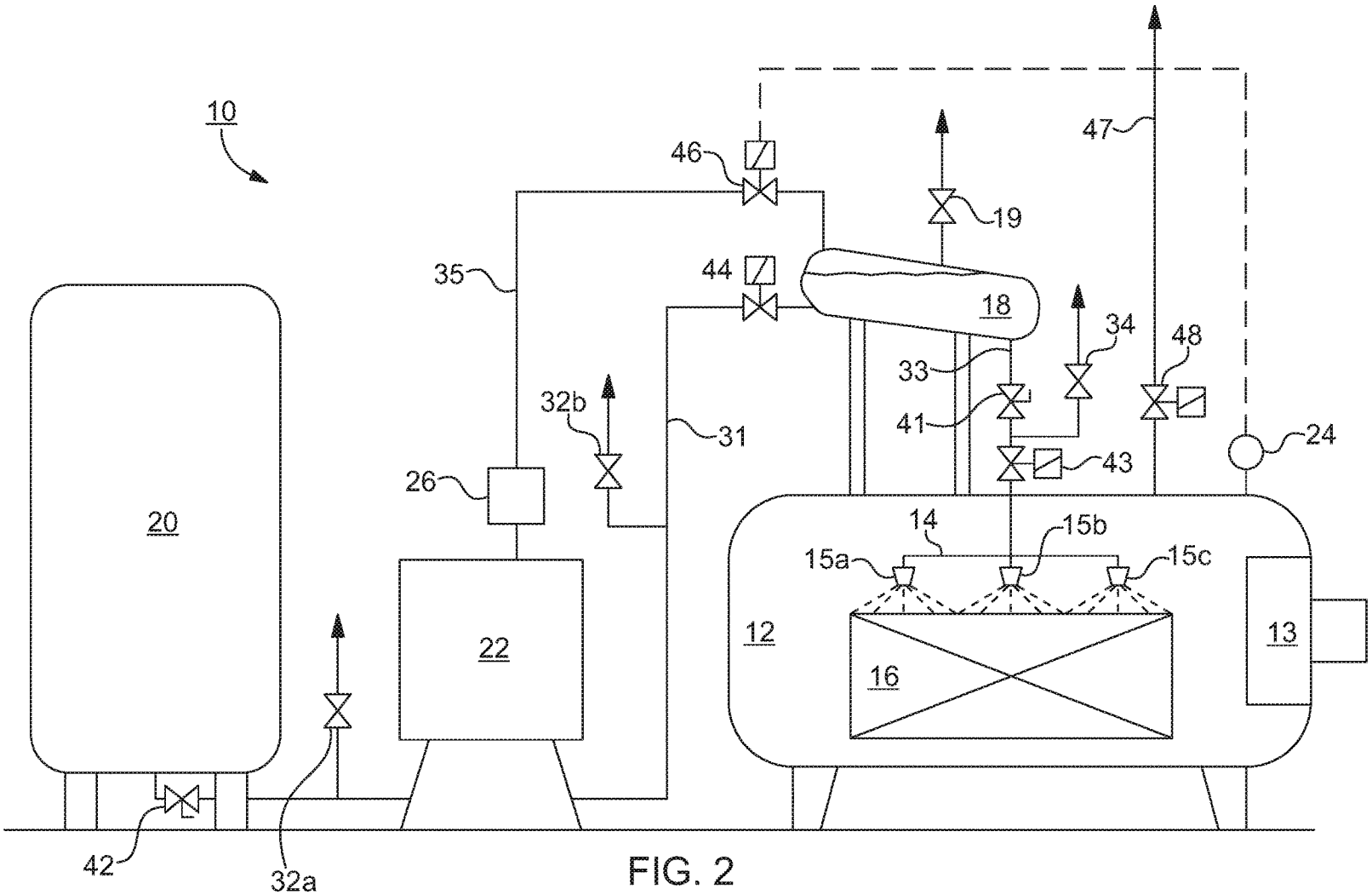
FIG. 2 is a schematic diagram of an embodiment of a high pressure quenching system in accordance with the present invention.

Referring now to the drawing and in particular to FIG. 2, there is shown an embodiment of a high pressure gas quenching system 10 in accordance with the present invention. The system 10 is configured for use with a heat treating furnace 12 that is equipped for high pressure gas quenching. Alternatively, the system 10 can be used with a stand-alone high pressure quenching chamber of the type to which a load of heat-treated parts is moved for quenching. The system 10 includes liquefied nitrogen ($LN_2$) supply tank 20 that is usually located outside the building where the heat treating furnace 12 is installed. The supply tank 20 contains $LN_2$ at a pressure that is preferably greater than about 2 bar. A first cryogenic pipe 31 connects the $LN_2$ supply tank 20 to an $LN_2$ storage tank 18 located in close proximity to the heat treatment furnace. A manual shut-off valve 42 is connected in the first cryogenic pipe 31, preferably in proximity to the supply tank 20. A solenoid-operated control valve 44 is preferably connected in the first cryogenic pipe 31 in proximity to the storage tank 18 for controlling the flow of $LN_2$ to the storage tank 18. First and second vent valves 32*a* and 32*b* are provided at respective first and second locations along the first cryogenic pipe 31. The first vent valve 32*a* is preferably located closer to supply tank 20. The second vent valve 32*b* is preferably located closer to storage tank 18. The first and second vent valves are typically embodied as spring-loaded safety relief devices that permit any overpressure in the cryogenic pipe 31 to be rapidly reduced when the set pressure limit of the valve is exceeded by a pressure buildup in the cryogenic pipe 31. The storage tank 18 is constructed to handle cryogenic temperatures. Preferably the storage tank has a double-wall construction with a vacuum established in the space between the inner and outer tank walls in order to minimize heat transfer into the storage tank 18. Alternatively or in addition, the storage tank is thermally insulated to a degree necessary to maintain the $LN_2$ at cryogenic temperature. A third vent valve 19 is provided on the storage tank 18 to prevent over-pressurization of the storage tank. The first cryogenic pipe 31 may also be double-walled construction or have sufficient thermal insulation to maintain the liquefied nitrogen at a cryogenic temperature.

The heat treating furnace 12 is constructed for holding a load of metal work-pieces 16 that are heat treated in the furnace. The load will typically be in the form of stacked baskets or containers of the metal work pieces. The heat treating furnace 12 includes a pressure vessel or quenching chamber that is capable of holding a quenching gas, such as nitrogen, at pressures of at least about 5 bar up to about 100 bar. The pressure vessel or quenching chamber preferably includes a recirculation fan 13 which operates to circulate the quenching gas in the furnace chamber. A heat exchanger (not shown) is also included for extracting heat from the quenching gas as it is recirculated through the heat exchanger. The heat exchanger is preferably located internally to the pressure vessel, but may be located externally in accordance with arrangements generally known to persons skilled in the art. Likewise, the recirculation fan may be located externally to the pressure vessel in accordance with arrangements generally known to persons skilled in the art. One or more spray nozzles 15*a*, 15*b*, 15*c*, may be connected from a cryogenic manifold 14. A second cryogenic pipe 33 is connected between the $LN_2$ storage tank 18 and the cryogenic manifold for supplying $LN_2$ gas to the spray nozzles 15*a*, 15*b*, and 15*c*. The $LN_2$ storage tank is preferably located in close proximity to the heat treating furnace, specifically to the quenching chamber of the furnace. In this way, second cryogenic pipe 33 is kept as short as possible. The second cryogenic pipe 33 preferably has an inside diameter that is dimensioned to allow the $LN_2$ to flow into the manifold 14 at a rate of about 1 to 15 l/s. Such a flow rate may allow the heat treating furnace 12 or quenching chamber to be pressurized to the desired quenching gas pressure within as little as 2-5 seconds. More typically, it is expected that the desired quenching gas pressure will be attained in about 10 to about 50 or 60 seconds. The spray nozzles are preferably constructed to provide a wide angle spray as shown in FIG. 2. A manual shut-off valve 41 may be connected in the second cryogenic pipe 33 in proximity to the storage tank 18. A solenoid-operated control valve 43 is connected in the second cryogenic pipe 33 in proximity to the furnace 12 for controlling the flow of the $LN_2$ from the storage tank 18 to the manifold 14 and the spray nozzles. A fourth vent valve 34, similar to vent valves 32*a* and 32*b* is provided on the second cryogenic pipe 33 to prevent overpressurization of that line.

A pipe or tube 47 extends from the interior of the pressure vessel or quenching chamber 12 to provide an overpressure exhaust port. A solenoid-operated valve 48 is connected in the pipe or tube 47 to control the flow of quenching gas from the interior of the pressure vessel or quenching chamber through the exhaust port and out to the atmosphere when the gas pressure inside the pressure vessel reaches a predefined peak value.

A high pressure source of pressurizing gas 22, preferably nitrogen, is connected to the storage tank 18 through high pressure gas tubing or pipe 35. The pressurizing gas source is preferably realized with a high pressure gas cylinder. A pressure regulator 26 may be connected in the high pressure tubing 35 in proximity to the high pressure gas source 22. A solenoid-operated control valve 46 is connected in the high pressure gas tubing 35 in proximity to the storage tank 18 for controlling the flow of gas from the source 22 to the storage tank 18. A pressure switch 24 is provided at the heat treating furnace 12 and is adapted to sense the gas pressure inside the pressure vessel or quenching chamber. The pressure switch 24 is connected to the control valve 46 for controlling the high pressure gas flow to the storage tank 18 from the gas source 22. In an alternative embodiment, a cryogenic fluid pump (not shown) can be connected in the $LN_2$ supply line 31 to pump the $LN_2$ up to a desired pressure in the storage tank 18.

The filling of the storage tank 18 is achieved by establishing a positive pressure differential in the $LN_2$ supply tank 20 relative to the storage tank 18. The volume of the storage tank 18 is selected such that the amount of $LN_2$ stored will be sufficient to bring the high pressure gas quench system of the heat treat furnace 12 to the desired gas pressure for quenching after evaporation of the liquefied nitrogen. For example, a high pressure gas quench system having a volume of 2 $m^3$ can be used for a quenching cycle that requires a gas pressure of 30 bar. This means that 60 $m^3$ of nitrogen gas are needed to reach this pressure, which requires at least 90 liters of $LN_2$ to be filled into the $LN_2$ storage tank 18.

When the storage tank 18 is filled with a sufficient amount of $LN_2$, it is closed-off completely by the valve 44 in the first cryogenic pipe 31 and valve 43 in the second cryogenic pipe 33. The pressure inside the storage tank is allowed to build up to a value sufficient to cause the liquefied nitrogen to flow from the storage tank 18 into the manifold 14 and spray nozzles 15*a*-15*c* in the heat treat furnace 12 at a flow rate sufficient to provide an amount (volume) of $LN_2$ that will cause the desired quench gas pressure to occur after evaporation of the $LN_2$ inside the furnace.

To achieve rapid evaporation of the $LN_2$ inside the heat treating furnace or quenching chamber, it is advantageous to spray the $LN_2$ flow with a widely diverging spray pattern. Although the embodiment shown in FIG. 2 shows an arrangement of three spray nozzles, the preferred spray pattern can be provided by using only one or two nozzles so long as the nozzles are constructed to provide a wide spray pattern.

Preferably, a constant pressure differential is maintained across the spray nozzles to provide a constant flow of $LN_2$. As an example of a suitable operating characteristic, the desired flow can be achieved by using a starting pressure of about 5 bar in the storage tank 18 and increasing the pressure in the storage tank during outflow of the $LN_2$ so that the storage tank pressure is always higher than the instantaneous gas pressure in the pressure vessel by at least about 3 bar. Thus, a final pressure of about 30 bar, for example, in the heat treating furnace 12 can be achieved by causing the pressure in the $LN_2$ storage tank to be about 33 bar, for example, during the cycle of supplying the liquefied nitrogen to the heat treating furnace. Alternatively, the pressure in the storage tank can be raised by starting at a pressure of 5 bar and continuously raising it to about 33 or 35 bar during the filling operation. The high pressure needed in the $LN_2$ storage tank is easily established by connecting it to the source 22 of nitrogen gas under very high pressure to the $LN_2$ storage tank.

The process according to the present invention is preferably realized through use of the apparatus described above. However, it is contemplated that other systems can be designed for carrying out the process. The quenching process according to the present invention is preferably utilized in an industrial metal heat treating process. Such a process typically includes the steps of heating a load of metal work pieces in a heat treating furnace to a desired temperature and then holding the metal work pieces at this temperature for a period of time sufficient to effect a desired metallurgical change in the metal work pieces. The heat treating furnace may be a vacuum furnace or an atmosphere furnace. The desired change in the metal work pieces is often effected or locked in by cooling the metal work pieces at a rapid rate.

In the method according to the present invention the heated metal parts are cooled by application of a cooling gas, preferably nitrogen, at high pressure. The cooling gas is preferably injected into the furnace or quenching chamber by conducting $LN_2$ from a local storage tank into the heat treating furnace chamber or into a standalone quenching chamber as the case may be. Feeding the $LN_2$ into a furnace quench chamber at a high flow rate against a gas pressure that has built up to about 25 bar or more requires a pressure in the $LN_2$ storage tank of at least about 30 bar or more. However, at such a pressure the boiling point of the $LN_2$ rises to about −151° C., which is 45° C. higher than when the pressure in the storage tank is at 1 bar. The spraying of $LN_2$ at a temperature of −151° C. into the high pressure quench chamber results in a reduction of the cooling capability of the quenching medium by about 22% as compared to spraying the $LN_2$ at a temperature of −196° C. Therefore, more effective cooling with $LN_2$ spray quenching can be provided when the $LN_2$ is super-cooled. Super cooling of the $LN_2$ can be accomplished by using the following steps.

Prior to the injection of $LN_2$ into the heat treating furnace or quenching chamber, the $LN_2$ is preferably held in the storage tank 18 at a relatively low pressure, for example at about 1 bar. As the process proceeds and $LN_2$ flows toward the heat treating furnace or quenching chamber, the pressure in the storage tank 18 is increased to a pressure that is greater than the final pressure required for the specific gas quench cycle. Alternatively, the pressure in the $LN_2$ storage tank can be set directly to a pressure of at least about 3 bar at the start of the quenching cycle and then, while the $LN_2$ flows toward the furnace or quench chamber, the pressure in the $LN_2$ storage tank is continuously increased at such a rate that the pressure is at any point of time during the quenching cycle at least 3 bar higher than the pressure in the furnace or quench chamber at the same time. The pressure in the storage tank is preferably increased or maintained, as the case may be, by injecting nitrogen gas at elevated pressure into the storage tank. The gas injection is preferably carried out by allowing nitrogen gas from the high pressure gas source 22 to flow into the storage tank 18 thereby providing a blanket of gas whose pressure is determined by the pressure regulator 26.

It is understood, that in carrying out the process of this invention, the $LN_2$ will initially evaporate as it is conducted from the storage tank to the furnace or quenching chamber because the supply pipe from the storage tank to the furnace chamber will not initially be at cryogenic temperature. As the supply pipe cools down to cryogenic temperature, the nitrogen will enter the chamber as a combination of cold nitrogen gas and liquefied nitrogen. When the supply pipe has cooled to substantially cryogenic temperature, the $LN_2$ will be conducted into the spray manifold in the furnace chamber and exit from the spray nozzles to be sprayed over the batches of metal work pieces. The conduction of the cooling gas in liquid form will provide a greater mass of the cooling gas into the furnace chamber thereby causing the gas pressure in the furnace chamber to rise rapidly. More specifically, it is expected that peak gas pressure for cooling in the furnace chamber can be achieved in 30 seconds or less from the start of the liquefied gas injection process.

During the injection of the cooling liquid into the furnace chamber, the vaporized nitrogen gas is preferably continuously circulated inside the chamber by means of the recirculation fan 13. The continuous circulation of the $LN_2$ mist and the cold nitrogen gas causes the gas/mist mixture to penetrate into the lower layers of the work piece load so that the lower layers of the stacked baskets or containers are cooled at the same or a similar rate as the uppermost baskets of work pieces. As the nitrogen gas/mist mixture absorbs heat from the metal work pieces, it transforms to all gas and rapidly expands inside the pressure vessel. The rapid expansion of the gas causes the pressure to rapidly rise also.

Once the gas pressure inside the furnace chamber reaches the desired peak value, the injection of the $LN_2$ can be stopped. The recirculation fan preferably continues to run so that the quenching gas is recirculated through the heat exchanger to remove additional heat from the load in the furnace chamber. The gas recirculation at the elevated pressure continues until the work pieces reach a preselected temperature in accordance with the known gas quenching processes.

Depending on the geometry of the load of metal parts, it may be advantageous to spray the liquid quenchant in a particular direction to maximize penetration of the gas/mist mixture into the work load. When such directional spraying is used, it may also be preferable to circulate the gas/mist mixture in a direction selected to further enhance contact of the cooling gas and mist with the metal parts. Therefore, in some embodiments the direction of circulation is selected to be parallel to the spraying direction. In another embodiment, the circulation of the gas and mist is circulated in a direction that is at an angle to the spraying direction, for example, at an angle of 90 degrees or 180 degrees relative to the spraying direction.

Figure 3:
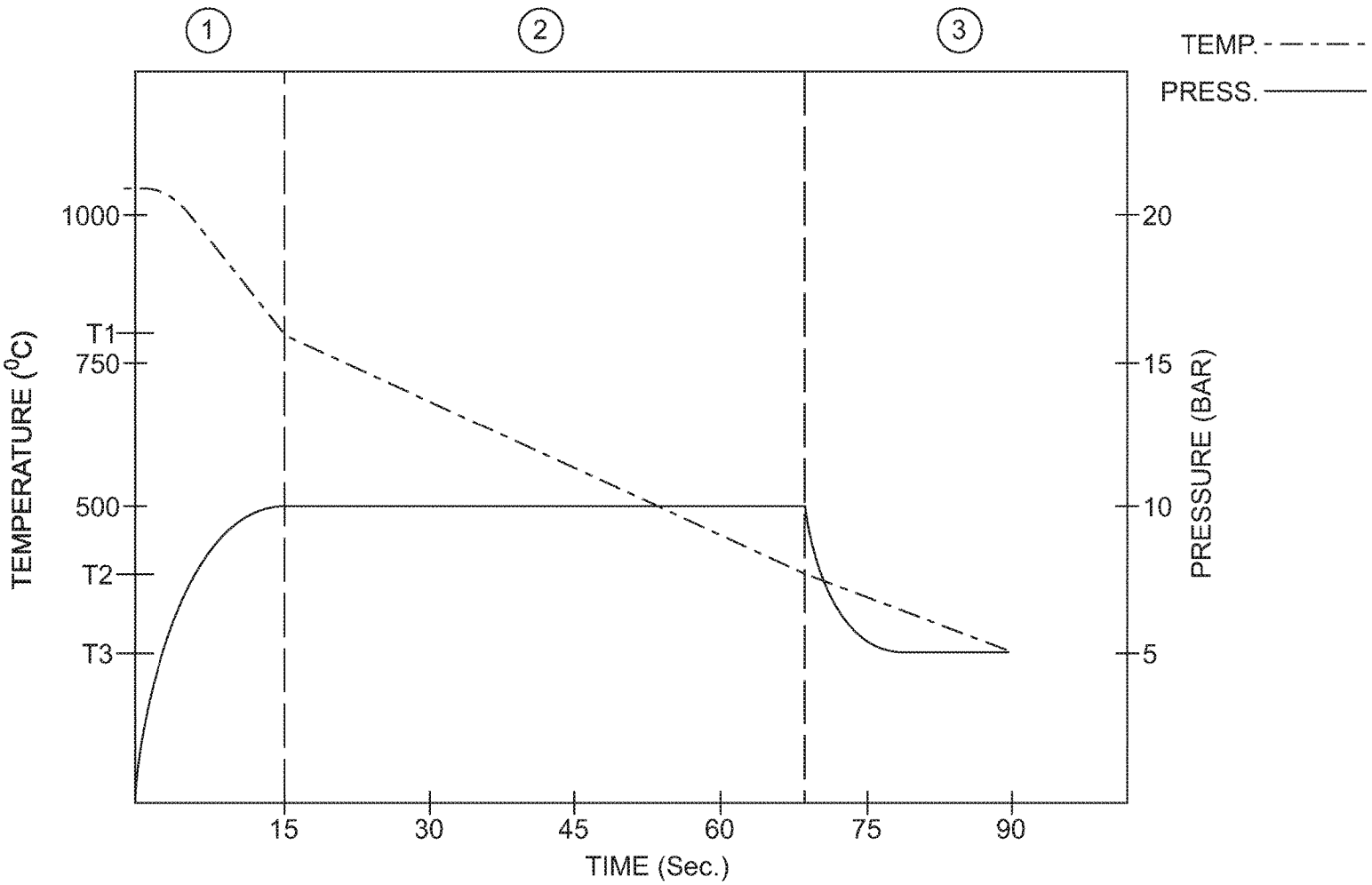
FIG. 3 is a graphical diagram of a gas quenching cycle in accordance with the present invention.

Referring now to FIG. 3, there is shown an example of a first or low pressure cooling cycle according to the present invention. In a first stage (1) of the cooling cycle, $LN_2$ is injected into a furnace chamber containing a load of metal parts that is at an elevated heat treatment temperature. As the $LN_2$ is injected, the gas pressure builds up to a peak level of about 10 bar. This stage lasts for about 15 seconds after which a first temperature (T1) is reached that is lower than the elevated heat treatment temperature. The gas recirculation fan is run simultaneously with the injection of the liquefied gas. In a second stage (2) the supply of $LN_2$ is stopped, but the gas pressure is maintained at its peak level and the gas recirculation fan continues to run until a second temperature (T2) lower than the first temperature is reached. In a third stage (3), after temperature T2 is reached, the gas pressure is reduced to about 5 bar while the gas recirculation fan is still running. The third stage is continued until the work load reaches a desired third temperature (T3) that is lower than temperature T2. For example, T3 may be room temperature or a higher temperature.

Depending on the overall load size, the section size of the parts in the load, and especially the type of steel or metal of the parts, the quenching speed of the second stage in the process of this invention (i.e., circulation of gas at high pressure) might not be sufficient. In such situation, it is possible to further supply the liquid quenchant into the furnace during (and vent off the vapor produced once it supersedes the chosen final peak pressure) for an additional time period during the first stage, until subsequently the transition to the second stage (pure high pressure gas quench) is made (stopping the flow of liquid). Such a process is exemplified in the following description of the example illustrated in FIG. 4.

Figure 4:
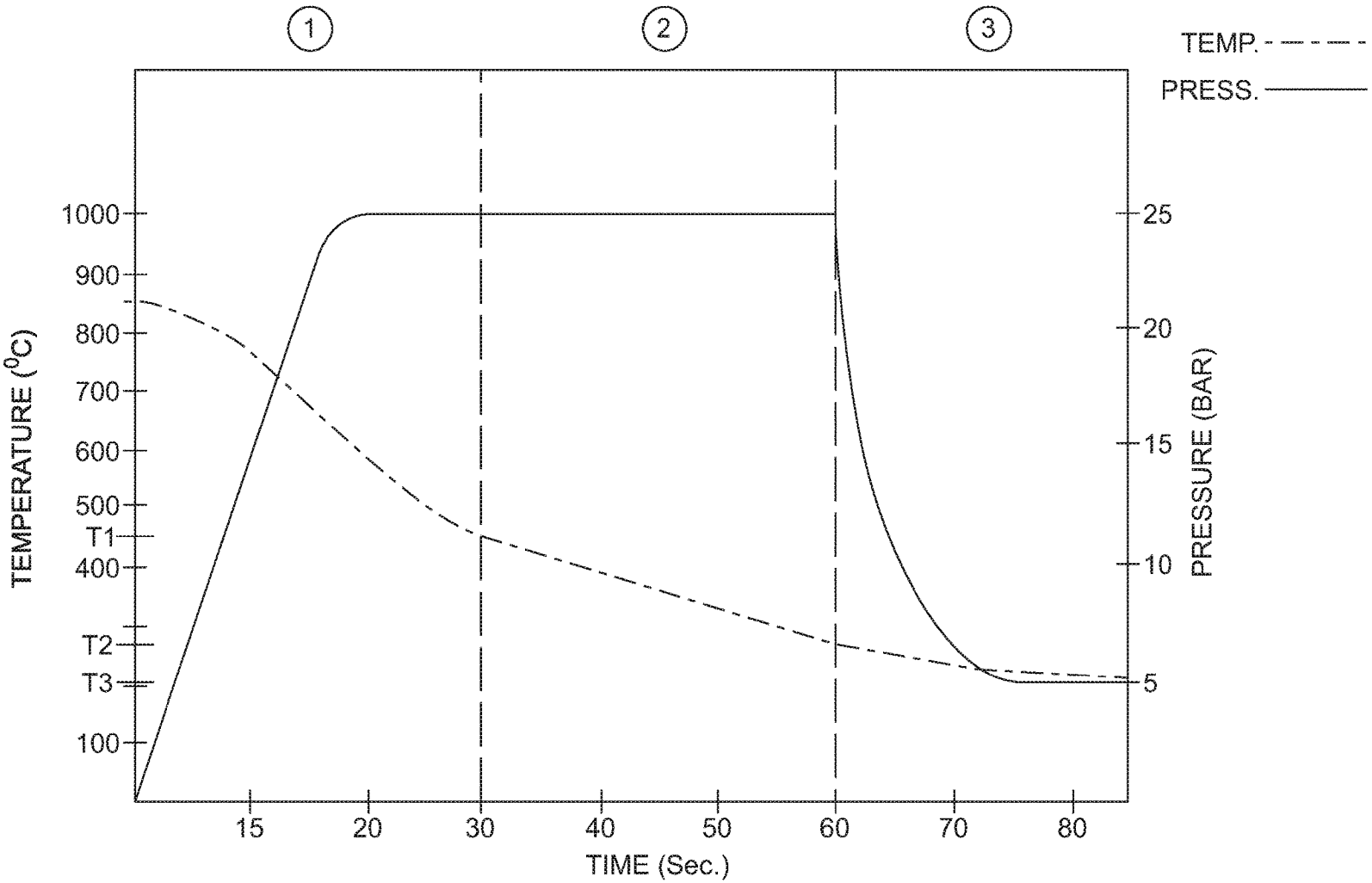
FIG. 4 is a graphical diagram of a second gas quenching cycle in accordance with the present invention

Referring now to FIG. 4, there is shown an example of a second or high pressure cooling cycle according to the present invention. In a first stage (1) of the second cooling cycle, $LN_2$ is injected into the furnace chamber containing a load of metal parts that is at an elevated heat treatment temperature. As the $LN_2$ is injected, the gas pressure builds up to a peak level of about 25 bar. The peak pressure is reached in about 20 seconds and the injection of $LN_2$ continues for an additional period of time until a first temperature T1 is reached that is lower than the elevated heat treatment temperature. The peak pressure is maintained by causing some of the cooling gas to be exhausted from the furnace chamber through the exhaust pipe 47. This first stage lasts for up to about 30 seconds in this example. The gas recirculation fan is run simultaneously with the injection of the liquefied gas. In a second stage (2) the supply of $LN_2$ is stopped, the gas pressure is maintained at its peak level, and the gas recirculation fan continues to run until a second temperature (T2) lower than the temperature T1 is reached. In a third stage (3), the gas pressure is reduced to about 5 bar while the gas recirculation fan is still running. The third stage is continued until the work load reaches the desired third temperature T3 that is lower than temperature T2.

During further cooling in the third stage of the process according to this invention, i.e., pure gas quenching, the gas temperature decreases which causes the gas to contract, thereby reducing the pressure in the quenching chamber. In order to maintain the pressure during a given cooling stage constant, the pressure control system is preferably adapted to intermittently open the valve for the liquid quenchant and allow more liquid to enter the furnace. The evaporation of the additional liquid increases the pressure in the quenching chamber back to the desired level.

It will be appreciated by those skilled in the art that the apparatus according to the invention can be realized by configurations other than that described above and shown in FIG. 2. It is contemplated by the inventors that the process according to the present invention can be carried out in any of numerous quenching cycle sequences. Thus, the invention is not limited to the two examples described above and shown in FIGS. 3 and 4. Moreover, the process and apparatus according to the invention can be used with a wide variety of liquid quenchants other than $LN_2$. Thus, it is believed that the process can be conducted with such other quenchants as liquefied helium, liquefied argon, liquefied air, a liquefied hydrocarbon, liquefied carbon dioxide, and a combination thereof. Moreover, the process according to the invention can be carried as a high pressure steam quench utilizing a liquid quenchant such as water, an aqueous quenchant solution, or a quenching oil. Quenchant solutions and quenching oils are well known to those skilled in the art as well as the knowledge of how to select a suitable oil or quenchant solution given the load size, part geometry, and part material.

The terms and expressions which have been employed are used as terms of description and not of limitation. There is no intention in the use of such terms and expressions of excluding any equivalents of the features or steps shown and described or portions thereof. It is recognized, therefore, that various modifications are possible within the scope and spirit of the invention. Accordingly, the invention incorporates variations that fall within the scope of the following claims.

The invention claimed is:

1. Apparatus for rapidly cooling a work load of heat treated metal parts comprising:

a pressure vessel having an internal chamber for holding a work load of heat treated metal parts;

a liquid quenchant supply vessel adapted to contain a liquid quenchant at a first pressure;

a storage tank for holding the liquid quenchant, said storage tank being connected to said liquid quenchant supply vessel for receiving the liquid quenchant therefrom and connected to said pressure vessel for supplying the liquid quenchant to the internal chamber of said pressure vessel;

pressurizing means connected to said storage tank for increasing pressure inside said storage tank; and a pressure controller connected to said pressure vessel and said pressurizing means for maintaining the pressure in said storage tank at a first elevated pressure relative to a chamber pressure in said pressure vessel wherein the first elevated pressure in said storage tank is selected to provide a flow of the liquid quenchant to the internal chamber sufficient to achieve a selected peak vapor pressure in the internal chamber of the pressure vessel when the liquid quenchant evaporates in said pressure vessel during a quenching cycle performed in said pressure vessel.

2. The apparatus as claimed in claim 1 wherein said pressure controller is configured to maintain the pressure in the storage tank at a level sufficient to provide a continuous flow rate of the liquid quenchant from said storage tank to the internal chamber of the pressure vessel during the quenching cycle.

3. Apparatus as claimed in claim 1 wherein the pressurizing means comprises a liquid pump connected in a quenchant supply line between said liquid quenchant supply vessel and said storage tank.

4. Apparatus as claimed in claim 1 wherein the pressurizing means comprises a source of pressurized gas.

5. Apparatus as claimed in claim 1 wherein the pressurizing means comprises a source of pressurizing gas at a second elevated pressure greater than said first elevated pressure and a pipe or tubing connected between said pressurizing gas source and said storage tank for conducting the pressurizing gas at said second elevated pressure from said pressurizing gas source to said storage tank.

6. Apparatus as claimed in claim 1 comprising a nozzle adapted for spraying the liquid quenchant in the pressure vessel chamber, said nozzle being operably connected to said quenchant conducting means and mounted in the internal chamber of the pressure vessel.

7. Apparatus as claimed in claim 6 wherein the pressure vessel is part of a heat treating furnace.

8. Apparatus as claimed in claim 6 wherein the pressure vessel is a standalone quenching chamber.

9. Apparatus as claimed in claim 1 comprising a fan operatively coupled to said pressure vessel for circulating quenchant vapor in the internal chamber of said pressure vessel.

10. Apparatus as claimed in claim 9 comprising a heat exchanger connected to said pressure vessel for extracting heat from the quenchant vapor as it is circulated in the pressure vessel.

11. Apparatus as claimed in claim 5 wherein the pressurizing means comprises a pressure regulator operably connected to the pressurizing gas source.

12. Apparatus as claimed in claim 6 comprising a second nozzle for spraying the liquid quenchant, said second nozzle being mounted in the pressure vessel and operatively connected to the liquid quenchant conducting means.

13. Apparatus as claimed in claim 6 wherein the quenchant conducting means comprises a manifold in the internal chamber of the pressure vessel and the nozzle is connected to said manifold.

14. Apparatus as claimed in claim 13 comprising a second nozzle connected to said manifold.

15. The apparatus as claimed in claim 1 wherein the pressure controller comprises a pressure switch disposed in said pressure vessel for sensing the pressure in the internal chamber and connected to said pressurizing means for providing a signal to said pressurizing means to increase the pressure in said storage tank.

16. The apparatus as claimed in claim 15 wherein the pressurizing means comprises:

a supply of pressurized gas;

a high pressure tubing or pipe connected between said pressurized gas supply and said storage tank;

a pressure regulator connected to the high pressure tubing or pipe proximal to said pressurized gas supply; and a control valve disposed in said high pressure tubing proximal to said storage tank; wherein said control valve is connected to said pressure switch for receiving a signal from said pressure switch whereby said control valve opens or closes in response to the signal from said pressure switch.

17. The apparatus as claimed in claim 1 wherein said liquid quenchant supply vessel is a cryogenic liquid supply tank and said storage tank includes thermal insulation for maintaining the liquid quenchant at a cryogenic temperature.

18. The apparatus as claimed in claim 17 comprising a first cryogenic pipe connected between said cryogenic liquid supply tank and said storage tank.

19. The apparatus as claimed in claim 18 comprising a second cryogenic pipe connected between said storage tank and said pressure vessel.

20. A method for rapidly cooling a load of heat treated metal parts from an elevated temperature in the rapid cooling apparatus set forth in claim 1, wherein the method comprises the steps of:

placing a load of heat treated metal parts into the pressure vessel, said load being at an elevated temperature after being heat treated;

providing a liquid quenchant from said liquid quenchant supply vessel to said storage tank;

injecting the liquid quenchant into the pressure vessel from the storage tank such that a vapor of the liquid quenchant forms rapidly in the pressure vessel and cools the metal parts;

controlling the injection of the liquid quenchant with the pressure controller and the pressurizing means to provide continuous injection of the liquid quenchant into the pressure vessel during the quenching cycle; and continuing the injecting step for a time sufficient to establish the selected peak vapor pressure in the pressure vessel.

21. The method as claimed in claim 20 wherein the selected peak vapor pressure is about 5 to 100 bar.

22. The method as claimed in claim 20 comprising the step of circulating the quenchant vapor at high velocity in the pressure vessel while the liquid quenchant is being injected into the pressure vessel such that the quenchant vapor penetrates through the load of metal parts.

23. The method as claimed in claim 22 wherein the injecting step comprises spraying the liquid quenchant in a preselected direction in the pressure vessel.

24. The method as claimed in claim 20 comprising the step of providing the liquid quenchant at an initial pressure that is higher than the selected peak vapor pressure in the pressure vessel.

25. The method as claimed in claim 24 wherein the pressure in the storage tank is maintained at a level that is higher than the quenchant vapor pressure in the pressure vessel by at least about 3 bar.

26. The method as claimed in claim 20 wherein the storage tank has an initial pressure that is about 3 to 5 bar.

27. The method as claimed in claim 20 wherein the injecting step comprises the step of continuously raising the pressure of the liquid quenchant during the injecting step such that the pressure of the liquid quenchant at any instant is higher than a concurrent quenchant vapor pressure in the pressure vessel.

28. The method as claimed in claim 27 wherein the pressure of the liquid quenchant at any instant is about 3 to 5 bar higher than the concurrent vapor pressure in the pressure vessel.

29. The method as claimed in claim 20 wherein the injecting step is stopped once the selected peak vapor pressure in the pressure vessel is reached.

30. The method as claimed in claim 29 comprising the steps of maintaining the quenchant vapor pressure in the pressure vessel at the selected peak vapor pressure and continuing to circulate the quenchant vapor for a time sufficient to lower the temperature of the metal parts to a first temperature lower than the elevated temperature.

31. The method as claimed in claim 20 comprising the steps of continuing the injecting step and maintaining the vapor pressure in the pressure vessel at the selected peak vapor pressure for a period of time after the selected peak vapor pressure in the pressure vessel is reached sufficient to lower the temperature of the metal parts to a first temperature lower than the elevated temperature.

32. The method as claimed in claim 31 wherein the peak vapor pressure in the pressure vessel is maintained at the selected level by venting a portion of the quenchant vapor from the pressure vessel.

33. The method as claimed in claim 30 or 31 wherein the peak vapor pressure in the pressure vessel is maintained at the selected pressure by injecting additional quenchant vapor into the pressure vessel.

34. The method as claimed in claim 30 comprising the step of reducing the quenchant vapor pressure in the pressure vessel to a lower pressure when the load of metal parts reaches the first temperature.

35. The method as claimed in claim 34 comprising the step of holding the quenchant vapor pressure in the pressure vessel at the lower pressure until the load of metal parts reaches a selected second temperature lower than the first temperature.

36. The method as claimed in claim 22 wherein the circulating step comprises the step of circulating the quenchant vapor through a heat exchanger located in the pressure vessel and circulating a heat absorbing fluid in the heat exchanger to absorb heat from the quenchant vapor.

37. The method as claimed in claim 20 wherein the injecting step is carried out with a flow rate that is effective to raise the vapor pressure in the pressure vessel to the selected peak vapor pressure within about 2 to 60 seconds from the start of the injecting step.

38. The method as claimed in claim 20 wherein the liquid quenchant is selected from the group consisting of liquefied nitrogen, liquefied helium, liquefied argon, liquefied air, a liquefied hydrocarbon gas, liquefied carbon dioxide, and a combination thereof.

39. The method as claimed in claim 20 wherein the liquid quenchant is water, an aqueous quenching solution, or oil.

* * * * *